US011573584B2

(12) United States Patent
Lee

(10) Patent No.: US 11,573,584 B2
(45) Date of Patent: Feb. 7, 2023

(54) VOLTAGE GENERATION CIRCUITS

(71) Applicant: SK hynix Inc., Icheon-si (KR)

(72) Inventor: Se Won Lee, Icheon-si (KR)

(73) Assignee: SK hynix Inc., Icheon-si (KR)

( * ) Notice: Subject to any disclaimer, the term of this patent is extended or adjusted under 35 U.S.C. 154(b) by 0 days.

(21) Appl. No.: 17/501,589

(22) Filed: Oct. 14, 2021

(65) Prior Publication Data

US 2022/0413529 A1 Dec. 29, 2022

(30) Foreign Application Priority Data

Jun. 28, 2021 (KR) ..... 10-2021-0084332

(51) Int. Cl.
*G05F 1/56* (2006.01)
*G05F 3/08* (2006.01)

(52) U.S. Cl.
CPC . *G05F 1/56* (2013.01); *G05F 3/08* (2013.01)

(58) Field of Classification Search
None
See application file for complete search history.

(56) References Cited

U.S. PATENT DOCUMENTS 7,148,667 B2 * 12/2006 Umemoto ..... H02M 3/156 323/282
8,482,267 B2 * 7/2013 Noda ..... H02M 3/158 323/284
8,860,391 B2 * 10/2014 Noda ..... H02M 3/156 323/315
9,099,924 B2 8/2015 Galloway

FOREIGN PATENT DOCUMENTS

KR 100420574 B1 5/2004

* cited by examiner

*Primary Examiner* — Jeffery S Zweizig
(74) *Attorney, Agent, or Firm* — William Park & Associates Ltd.

(57) ABSTRACT

A voltage generation circuit includes an operation voltage driving circuit configured to drive an operation voltage based on a calibration voltage and a feedback voltage and generate the feedback voltage from the operation voltage. The voltage generation circuit also includes a reference voltage calibration circuit configured to generate the calibration reference voltage, wherein the calibration reference voltage varies based on a set value calculated according to the feedback voltage and a reference voltage.

53 Claims, 24 Drawing Sheets

FIG.4

$$VINT = VREF - \underbrace{\frac{1}{RC}\int (FBV-VREF)dt}_{\text{SET VALUE}}$$

FIG.6

| SET VALUE | VINT |
| --- | --- |
| '−' | INCREASE |
| '+' | DECREASE |

FIG.7

| COMPARE VINT & VREF | VDET |
|---|---|
| VINT ≥ VREF | 'L' |
| VINT < VREF | 'H' |

FIG.11

| VDET DV | SCD |
|---|---|
| 0 | '0000' |
| 1 | '0001' |
| 2 | '0010' |
| 3 | '0011' |
| 4 | '0100' |
| 5 | '0101' |
| 6 | '0110' |
| 7 | '0111' |
| 8 | '1000' |
| 9 | '1001' |
| 10 | '1010' |
| 11 | '1011' |
| 12 | '1100' |
| 13 | '1101' |
| 14 | '1110' |
| 15 | '1111' |

FIG.15

$$(1)\quad VINT = VREF - \underbrace{\frac{1}{R_1C}\int(FBV-VREF)dt}_{\text{1st SET VALUE}} - \underbrace{\frac{1}{R_2C}\int(VRP-VREF)dt}_{\text{2nd SET VALUE}}$$

$$(2)\quad VINT = VREF - \underbrace{\frac{1}{R_1C}\int(FBV-VREF)dt}_{\text{1st SET VALUE}} - \underbrace{\frac{1}{R_2C}\int(VRN-VREF)dt}_{\text{3rd SET VALUE}}$$

FIG.16

| 1st SET VALUE | VINT |
| --- | --- |
| '−' | INCREASE |
| '+' | DECREASE |

FIG.17

| | | |
|---|---|---|
| RST = 'H' | SW1 = 'H' | CAPACITOR DISCHARGE |
| VDET = 'L' | SW2 = 'H' | VINT DECREASE |
| VDET = 'H' | SW3 = 'H' | VINT INCREASE |

VOLTAGE GENERATION CIRCUITS

CROSS-REFERENCE TO RELATED APPLICATIONS

The present application claims priority under 35 U.S.C. 119(a) to Korean Patent Application No. 10-2021-0084332, filed on Jun. 28, 2021, which is incorporated herein by reference in its entirety.

BACKGROUND

1. Technical Field

Embodiments of the present disclosure relate to voltage generation circuits for calibrating a reference voltage.

2. Related Art

An electronic device generates various operation voltages necessary to perform various internal operations. The operation voltages generated by the electronic device should be generated at a uniform level even when various external variations such as temperature and operation voltage occur. Because the operation voltage is generated based on a reference voltage, in order for the operation voltage to be generated at a uniform level, the reference voltage needs to maintain a uniform level even against external variations.

SUMMARY

According to an embodiment of the present invention, a voltage generation circuit includes an operation voltage driving circuit configured to drive an operation voltage based on a calibration reference voltage and a feedback voltage and generate the feedback voltage from the operation voltage. The voltage generation circuit also includes a reference voltage calibration circuit configured to generate the calibration reference voltage, wherein the calibration reference voltage varies based on a set value calculated according to the feedback voltage and a reference voltage.

In addition, according to another embodiment of the present invention, a voltage generation circuit includes an operation voltage driving circuit configured to drive an operation voltage based on a calibration reference voltage and a feedback voltage and generate the feedback voltage from the operation voltage. The voltage generation circuit also includes a reference voltage calibration circuit configured to compare the feedback voltage with a reference voltage in synchronization with a clock to generate a detection voltage and generate the calibration reference voltage from the detection voltage and the reference voltage in response to an initial code.

In addition, according to another embodiment of the present invention, a voltage generation circuit includes an operation voltage driving circuit configured to drive an operation voltage based on a calibration reference voltage and a feedback voltage and generate the feedback voltage from the operation voltage. The voltage generation circuit also includes a detection voltage generator configured to calculate a first set value based on a time-integrated value of the level difference between the feedback voltage and the reference voltage, calculate a second set value based on a time-integrated value of the level difference between an upper limit reference voltage and the reference voltage, calculate a third set value based on a time-integrated value of the level difference between a lower limit reference voltage and the reference voltage, and generate a detection voltage based on at least one of the first, second, and third set values. The voltage generation circuit further includes a calibration reference voltage generator configured to generate the calibration reference voltage whose level varies according to a result of sensing the detection voltage based on a clock.

In addition, according to another embodiment of the present invention, a voltage generation circuit includes a switching control circuit configured to generate a first switching signal, a second switching signal, and a third switching signal based on a reset signal and a clock. The voltage generation circuit also includes an operation voltage driving circuit configured to drive an operation voltage based on a calibration reference voltage and a feedback voltage and generate the feedback voltage from the operation voltage. The voltage generation circuit further includes a calibration reference voltage generator configured to receive the first switching signal, the second switching signal, and the third switching signal and generate the calibration reference voltage, wherein the calibration reference voltage varies based on a set value calculated from the feedback voltage and the reference voltage.

BRIEF DESCRIPTION OF THE DRAWINGS

FIGS. 4 to 7 are diagrams illustrating an operation of the detection voltage generator illustrated in FIG. 3.

FIGS. 11 and 12 are diagrams illustrating an operation of the calibration reference voltage generator illustrated in FIGS. 8 to 10.

FIGS. 15 to 17 are diagrams illustrating an operation of the voltage generation circuit illustrated in FIGS. 13 and 14.

DETAILED DESCRIPTION OF THE EMBODIMENTS

In the following description of embodiments, when a parameter is referred to as being "predetermined," it may be intended to mean that a value of the parameter is determined in advance of when the parameter is used in a process or an algorithm. The value of the parameter may be set when the process or the algorithm starts or may be set during a period in which the process or the algorithm is executed.

It will be understood that although the terms "first," "second," "third," etc. are used herein to describe various elements, these elements should not be limited by these terms. These terms are only used to distinguish one element from another element and are not intended to imply an order or number of elements. Thus, a first element in some embodiments could be termed a second element in other embodiments without departing from the teachings of the present disclosure.

Further, it will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

A logic "high" level and a logic "low" level may be used to describe logic levels of electric signals. A signal having a logic "high" level may be distinguished from a signal having a logic "low" level. For example, when a signal having a first voltage corresponds to a signal having a logic "high" level, a signal having a second voltage corresponds to a signal having a logic "low" level. In an embodiment, the logic "high" level may be set as a voltage level which is higher than a voltage level of the logic "low" level. Meanwhile, logic levels of signals may be set to be different or opposite according to the embodiments. For example, a certain signal having a logic "high" level in one embodiment may be set to have a logic "low" level in another embodiment.

Various embodiments of the present disclosure will be described hereinafter in detail with reference to the accompanying drawings. However, the embodiments described herein are for illustrative purposes only and are not intended to limit the scope of the present disclosure.

Figure 1:
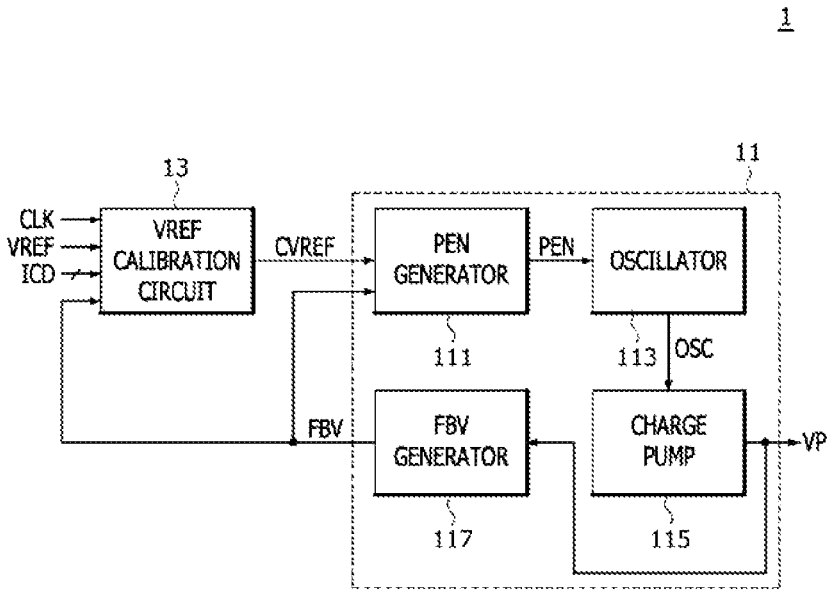
FIG. 1 is a block diagram illustrating a configuration of a voltage generation circuit, according to an embodiment of the present disclosure.

FIG. 1 is a block diagram illustrating a configuration of a voltage generation circuit 1, according to an embodiment of the present disclosure. As illustrated in FIG. 1, the voltage generation circuit 1 may include an operation voltage driving circuit 11 and a reference voltage calibration circuit (VREF CALIBRATION CIRCUIT) 13. The operation voltage driving circuit 11 may include a drive control signal generator (PEN GENERATOR) 111, an oscillator 113, a charge pump 115, and a feedback voltage generator (FBV GENERATOR) 117.

The drive control signal generator 111 may receive a calibration reference voltage CVREF from the reference voltage calibration circuit 13 and may receive a feedback voltage FBV from the feedback voltage generator 117. The drive control signal generator 111 may generate a drive control signal PEN based on the calibration reference voltage CVREF and the feedback voltage FBV. The drive control signal generator 111 may generate a drive control signal PEN activated when the feedback voltage FBV is at a lower level than the calibration reference voltage CVREF. The logic level at which the drive control signal PEN is activated may be set differently depending on the embodiment.

The oscillator 113 may receive the drive control signal PEN from the drive control signal generator 111. The oscillator 113 may generate an oscillating signal OSC based on the drive control signal PEN. The oscillator 113 may generate the oscillating signal OSC that toggles with a preset period when the drive control signal PEN is activated. The period of the oscillating signal OSC may be set differently depending on the embodiment.

The charge pump 115 may receive the oscillating signal OSC from the oscillator 113. The charge pump 115 may pump an operation voltage VP based on the oscillating signal OSC. The charge pump 115 may pump the operation voltage VP to a level higher than a power supply voltage VDD or to a level lower than a ground voltage VSS using the coupling of a capacitor caused when the oscillating signal OSC toggles.

The feedback voltage generator 117 may receive the operation voltage VP from the charge pump 115. The feedback voltage generator 117 may generate a feedback voltage FBV based on the operation voltage VP. The feedback voltage generator 117 may generate the feedback voltage FBV by dividing the operation voltage VP. The feedback voltage FBV may be generated at a lower level than the operation voltage VP. According to an embodiment, the feedback voltage generator 117 may be implemented to generate the feedback voltage FBV by buffering the operation voltage VP.

The reference voltage calibration circuit 13 may receive the feedback voltage FBV from the feedback voltage generator 117. The reference voltage calibration circuit 13 may generate the calibration reference voltage CVREF based on the feedback voltage FBV, a clock CLK, a reference voltage VREF, and an initial code ICD. The reference voltage calibration circuit 13 may generate the calibration reference voltage CVREF whose level is changed from an initial level of the reference voltage VREF based on a set value calculated from the feedback voltage FBV and the reference voltage VREF. Here, the set value may be set to a value obtained by time-integrating a level difference between the feedback voltage FBV and the reference voltage VREF, and the initial level of the reference voltage VREF may correspond to a bit combination of the initial code ICD. The reference voltage calibration circuit 13 may generate the calibration reference voltage CVREF whose level is increased when the value obtained by time-integrating the level difference between the feedback voltage FBV and the reference voltage VREF has a negative (−) value. The reference voltage calibration circuit 13 may generate the calibration reference voltage CVREF whose level is decreased when the value obtained by time-integrating a level difference between the feedback voltage FBV and the reference voltage VREF has a positive (+) value.

The voltage generation circuit 1 according to the present embodiment includes the operation voltage driving circuit 11 that drives the operation voltage VP based on the oscillating signal OSC, and the reference voltage calibration circuit 13 that calibrates the reference voltage VREF based on the clock CLK. When the cycle of the clock CLK is set to be N times longer than the cycle of the oscillating signal OSC, the speed at which the voltage generation circuit 1 drives the operation voltage VP may be set to be N times greater than the speed at which the reference voltage calibration circuit 13 calibrates the reference voltage VREF. That is, the voltage generation circuit 1 according to the present embodiment may be set to calibrate the reference voltage VREF once in synchronization with the clock CLK whenever the operation voltage VP is driven N times in synchronization with the oscillating signal OSC.

Figure 2:
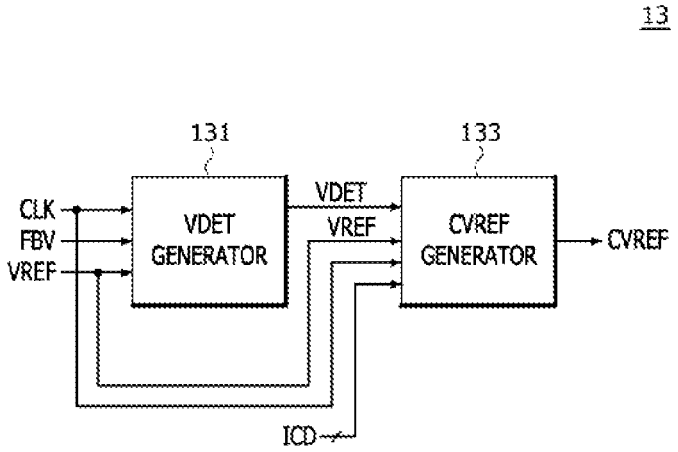
FIG. 2 is a block diagram illustrating a configuration, according to an embodiment, of a reference voltage calibration circuit included in the voltage generation circuit illustrated in FIG. 1.

FIG. 2 is a block diagram illustrating a configuration, according to an embodiment, of the reference voltage calibration circuit 13 of FIG. 1. As illustrated in FIG. 2, the reference voltage calibration circuit 13 may include a detection voltage generator (VDET GENERATOR) 131, and a calibration reference voltage generator (CVREF GENERATOR) 133.

The detection voltage generator 131 may generate a detection voltage VDET based on a feedback voltage FBV, a clock CLK, and a reference voltage VREF. The detection voltage generator 131 may generate an initial voltage (VINT of FIG. 3) whose level varies based on a set value calculated from the feedback voltage FBV and the reference voltage VREF. Here, the set value calculated from the feedback voltage FBV and the reference voltage VREF may be set to a value obtained by time-integrating the level difference between the feedback voltage FBV and the reference voltage VREF. The detection voltage generator 131 may compare the reference voltage VREF and the initial voltage VINT based on the clock CLK to generate the detection voltage VDET.

The calibration reference voltage generator 133 may receive the detection voltage VDET from the detection voltage generator 131. The calibration reference voltage generator 133 may generate a calibration reference voltage CVREF based on the detection voltage VDET, the reference voltage VREF, the clock CLK, and an initial code ICD. The calibration reference voltage generator 133 may detect a logic level of the detection voltage VDET in synchronization with the clock CLK to generate a set code (SCD of FIG. 8) including information on the number of times that the detection voltage VDET is generated at a preset logic level during a period set by the clock CLK. The calibration reference voltage generator 133 may calculate an error code (ECD of FIG. 8) based on the difference between the set code (SCD of FIG. 8) and the initial code ICD, and may accumulate the error code ECD and add the accumulated result to the initial code ICD to generate a calibration code (CCD of FIG. 8) for calibrating the reference voltage VREF. The calibration reference voltage generator 133 may generate the calibration reference voltage CVREF whose level is decreased when the number of times that the detection voltage VDET is generated to a preset logic level increases during a period set by the clock CLK. The calibration reference voltage generator 133 may generate the calibration reference voltage CVREF whose level is increased when the number of times that the detection voltage VDET is generated to a preset logic level decreases during a period set by the clock CLK.

Figure 3:
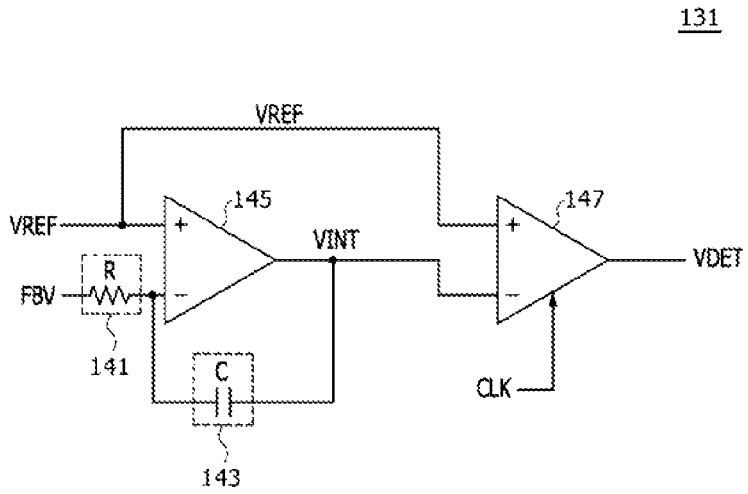
FIG. 3 is a circuit diagram, according to an embodiment, of a detection voltage generator included in the reference voltage calibration circuit illustrated in FIG. 2.

FIG. 3 is a circuit diagram, according to an embodiment, of the detection voltage generator 131 illustrated in FIG. 2. As illustrated in FIG. 3, the detection voltage generator 131 may include a resistor 141, a capacitor 143, an initial voltage driver 145, and a detection voltage driver 147. The resistor 141 may be connected between a feedback voltage FBV and a negative (−) input terminal of the initial voltage driver 145 and may have a resistance R. The capacitor 143 may be connected between the negative (−) input terminal of the initial voltage driver 145 and an output terminal of the initial voltage driver 145 and may have a capacitance of C. The initial voltage driver 145 may receive a reference voltage VREF at its positive (+) input terminal, and may receive a feedback voltage FBV input through the resistor 141 at its negative (−) input terminal. The initial voltage driver 145 may generate an initial voltage VINT whose level varies according to a set value calculated based on the reference voltage VREF and the feedback voltage FBV. The set value of the initial voltage driver 145 may be set to a value obtained by time-integrating a value obtained by subtracting the level of the reference voltage VREF from the level of the feedback voltage FBV and multiplying the time-integrated value by a reciprocal of a time constant. The time constant may be set as a value obtained by multiplying the resistance R of the resistor 141 by the capacitance C of the capacitor 143. The initial voltage driver 145 may generate an initial voltage VINT whose level increases when the set value has a negative (−) value. The initial voltage driver 145 may generate an initial voltage VINT whose level decreases when the set value has a positive (+) value. The detection voltage driver 147 may compare the reference voltage VREF and the initial voltage VINT based on the clock CLK to generate a detection voltage VDET. The detection voltage driver 147 may compare the reference voltage VREF and the initial voltage VINT based on a preset edge of the clock CLK. For example, the detection voltage driver 147 may generate the detection voltage VDET set to have a logic "low" level when the initial voltage VINT has a level greater than or equal to a level of the reference voltage VREF in synchronization with a rising edge of the clock CLK and may generate a detection voltage VDET set to have a logic "high" level when the initial voltage VINT has a level less than a level of the reference voltage VREF in synchronization with the rising edge of the clock CLK. Each of the initial voltage driver 145 and the detection voltage driver 147 may be implemented with an operational amplifier (OP AMP).

FIGS. 4 to 7 are diagrams illustrating an operation of the detection voltage generator 131 illustrated in FIG. 3. The operation of the detection voltage generator 131 will be described with reference to FIGS. 4 to 7.

Referring to FIG. 4, the formula of the initial voltage VINT generated by the initial voltage driver 145 may be checked. As illustrated in FIG. 4, the initial voltage VINT may be set to a value obtained by subtracting a set value from the reference voltage VREF. The set value of the initial voltage driver 145 may be set to a value obtained by subtracting the level of the reference voltage VREF from the level of the feedback voltage FBV, integrating the difference over time $\int(FBV-VREF)dt$ and multiplying the time-integrated value by the reciprocal of the time constant RC.

Figure 5:
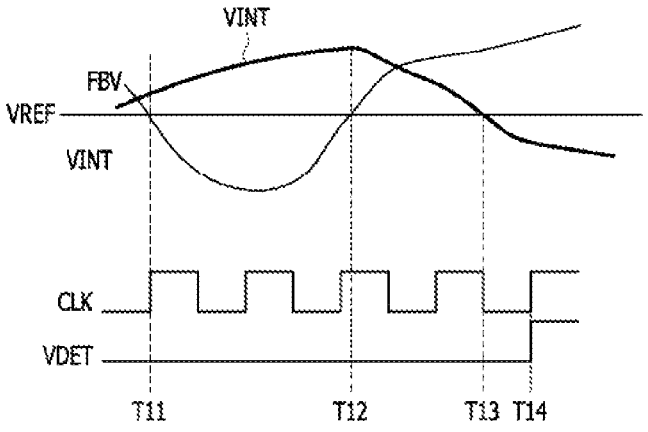

Referring to FIG. 5, the operation of generating the initial voltage VINT in the initial voltage driver 145 proceeds as follows. First, the set value of the initial voltage driver 145 has a negative (−) value during the period from time T11 to time T12, so that the level of the initial voltage VINT generated in the initial voltage driver 145 increases. Next, the set value of the initial voltage driver 145 has a positive (+) value during the period from time T12 to time T14, so that the level of the initial voltage VINT generated in the initial voltage driver 145 decreases. The initial voltage VINT has a level greater than or equal to the level of the reference voltage VREF in synchronization with a rising edge of the clock CLK in the period before T13 when the initial voltage VINT has a level equal to or higher than the level of the reference voltage VREF, so that the detection voltage VDET is set to have a logic "low" level. Meanwhile, the initial voltage VINT decreases to have a level less than the level of the reference voltage VREF at time T13 and the initial voltage VINT has a level less than the level of the reference voltage VREF in synchronization with the rising edge of the clock CLK at the time T14, so that the detection voltage VDET transitions from a logic "low" level to a logic "high" level.

Referring to FIG. 6, the level change of the initial voltage VINT according to the set value of the initial voltage driver 145 may be checked. As illustrated in FIG. 6, when the set value of the initial voltage driver 145 has a negative (−) value, the level of the initial voltage VINT increases, and when the set value of the initial voltage driver 145 has a positive (+) value, the level of the initial voltage VINT decreases.

Referring to FIG. 7, the logic level of the detection voltage VDET according to the comparison result of the reference voltage VREF and the initial voltage VINT may be checked. For example, when the initial voltage VINT has a level equal to or higher than the level of the reference voltage VREF in synchronization with the rising edge of the clock CLK, a detection voltage VDET set to have a logic "low" level is generated, and when the initial voltage VINT has a level less than the level of the reference voltage VREF in synchronization with the rising edge of the clock CLK, a detection voltage VDET set to have a logic "high" level is generated.

Figure 8:
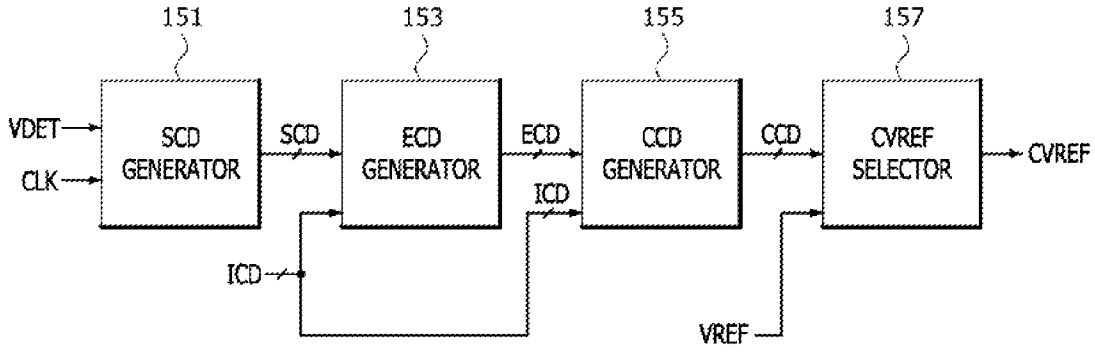
FIG. 8 is a block diagram illustrating a configuration, according to an embodiment, of a calibration reference voltage generator included in the reference voltage calibration circuit illustrated in FIG. 2.

FIG. 8 is a block diagram illustrating a configuration, according to an embodiment, of the calibration reference voltage generator 133 illustrated in FIG. 2. As illustrated in FIG. 8, the calibration reference voltage generator 133 may include a set code generator (SCD GENERATOR) 151, an error code generator (ECD GENERATOR) 153, a calibration code generator (CCD GENERATOR) 155, and a calibration reference voltage selector (CVREF SELECTOR) 157.

The set code generator 151 may generate a set code SCD based on a clock CLK and a detection voltage VDET. The set code generator 151 may be implemented with a low pass filter such as a sinc filter to generate the set code SCD including information on the number of times that the detection voltage VDET is generated at a preset logic level during a period set by the clock CLK. More specifically, the set code generator 151 may generate the set code SCD whose bit combination is set according to the number of times that the detection voltage VDET is generated at a preset logic level in synchronization with a preset edge of the clock CLK during a preset cycle of the clock CLK. For example, the set code generator 151 may generate the set code SCD that is sequentially up-counted by 1 bit from the bit combination '0001' to the bit combination '1111' when the number of times the detection voltage VDET is generated at a logic "high" level increases from '1' to '15' in synchronization with the rising edge of the clock CLK during 15 cycles of the clock CLK. As the level of the initial voltage VINT decreases by the set value of the initial voltage driver 145 having a positive (+) value, the set code generator 151 may generate the set code SCD having a bit combination that is up-counted in order to have an increased set code value as the period in which the level of the initial voltage VINT is set to be less than the level of the reference voltage VREF during the preset period of the clock CLK increases. As the level of the initial voltage VINT increases by the set value of the initial voltage driver 145 having a negative (−) value, the set code generator 151 may generate the set code SCD having a bit combination that is down-counted in order to have a reduced set code value as the period in which the level of the initial voltage VINT is set to be higher than the level of the reference voltage VREF during the preset period of the clock CLK increases.

The error code generator 153 may receive the set code SCD from the set code generator 151. The error code generator 153 may generate an error code ECD based on the set code SCD and an initial code ICD. The initial code ICD may have a bit combination corresponding to an initial level of the reference voltage VREF. The reference voltage VREF may be set to the initial level until the reference voltage VREF is calibrated by the calibration reference voltage generator 133 of FIG. 2. The error code generator 153 may generate the error code ECD based on the set code SCD and the initial code ICD. More specifically, the error code generator 153 may generate the error code ECD having a bit combination corresponding to an error code value generated by subtracting the set code value set by the bit combination of the set code SCD from the initial code value set by the initial code ICD. For example, in a state that the initial code ICD has bit combination '0110' corresponding to initial code value '6' and the set code SCD has bit combination '1001' corresponding to set code value '9', the error code ECD has bit combination '10011' corresponding to error code value '-3' calculated by subtracting set code value '9' from initial code value '6'. The most significant bit '1' of the error code ECD corresponds to a negative sign (−), and the remaining bits '0011' of the error code ECD correspond to '3'. Similarly, in a state that the initial code ICD has bit combination '0110' corresponding to initial code value '6', and the set code SCD has bit combination '0100' corresponding to set code value '4', the error code ECD has bit combination '00010' corresponding to error code value '2' calculated by subtracting set code value '4' from initial code value '6'. The most significant bit '0' of the error code ECD corresponds to a positive (+) sign, and the remaining bits '0010' of the error code ECD correspond to '2'. In the present embodiment, the error code ECD is set to be 1 bit larger than the set code SCD and the initial code ICD because the error code ECD includes a bit corresponding to the sign, but this is only an embodiment and may be set differently depending on the embodiment.

The calibration code generator 155 may receive the error code ECD from the error code generator 153. The calibration code generator 155 may generate the calibration code CCD based on the error code ECD and the initial code ICD. The calibration code generator 155 may accumulate and store error code values of the sequentially input error codes ECD and may add the accumulated error code value calculated from the error code values of the accumulated error code ECD to the initial code ICD to generate the calibration code CCD. For example, in a state that the initial code ICD has bit combination '0110' corresponding to initial code value '6', when the error code ECD having bit combination '10011' corresponding to error code value '-3' and the error code ECD having bit combination '00010' corresponding to error code value '2' are sequentially input, the calibration code generator 155 adds the accumulated error code value '-1' calculated by accumulating error code value '2' to error code value '-3' to the initial code value '6' of the initial code ICD to generate a calibration code CCD having bit combination '0101' corresponding to calibration code value '5'.

The calibration reference voltage selector 157 may receive the calibration code CCD from the calibration code generator 155. The calibration reference voltage selector 157 may calibrate the reference voltage VREF based on the calibration code CCD to generate a calibration reference voltage CVREF. The calibration reference voltage selector 157 may generate the calibration reference voltage CVREF whose level increases when a calibration code value set by the calibration code CCD increases. The calibration reference voltage selector 157 may generate the calibration reference voltage CVREF whose level is decreased when the calibration code value set by the calibration code CCD decreases.

Figure 9:
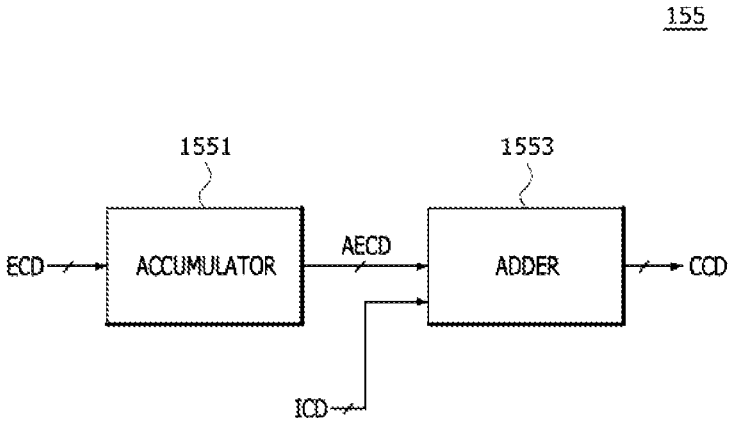
FIG. 9 is a block diagram illustrating a configuration, according to an embodiment, of a calibration code generator included in the calibration reference voltage generator illustrated in FIG. 8.

FIG. 9 is a block diagram illustrating a configuration, according to an embodiment, of the calibration code generator 155 illustrated in FIG. 8. As illustrated in FIG. 9, the calibration code generator 155 may include an accumulator (ACCUMULATOR) 1551, and an adder (ADDER) 1553.

The accumulator 1551 may generate an accumulation error code AECD based on an error code ECD. The accumulator 1551 may accumulate and store the error code values of sequentially input error codes ECD, and may output the accumulation error code AECD having a bit combination corresponding to the accumulated error code value calculated from the error code values of the accumulated error codes ECD. The accumulation error code AECD may have bit combination '00000' corresponding to initial accumulated error code value '0'. For example, when the error code ECD having bit combination '10011' corresponding to error code value '−3' is input, the accumulator 1551 generates an accumulation error code AECD having bit combination '10011' corresponding to the accumulated error code value '−3' calculated by adding the error code value '−3' to the initial accumulated error code value '0'. Similarly, when an error code ECD having bit combination '00010' corresponding to error code value '2' is additionally input, the accumulator 1551 generates an accumulation error code AECD having bit combination '10001' corresponding to accumulated error code value '−1' calculated by adding the error code value '2' to the accumulated error code value '−3'.

The adder 1553 may receive the accumulation error code AECD from the accumulator 1551. The adder 1553 may add the accumulation error code AECD to the initial code ICD to generate a calibration code CCD. For example, when an accumulation error code AECD having bit combination '10011' corresponding to accumulated error code value '−3' is received from the accumulator 1551, the adder 1553 adds the accumulated error code value '−3' to initial code value '6' to generate a calibration code CCD having bit combination '0011' corresponding to calibration code value '3'.

Figure 10:
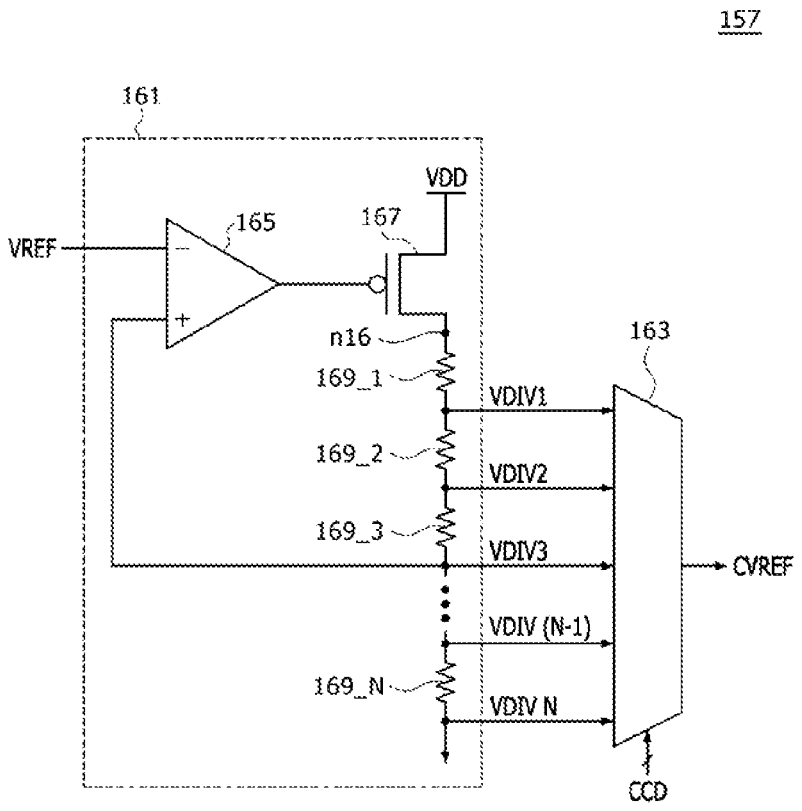
FIG. 10 is a circuit diagram, according to an embodiment, of a calibration reference voltage selector included in the calibration reference voltage generator illustrated in FIG. 8.

FIG. 10 is a circuit diagram, according to an embodiment, of the calibration reference voltage selector 157 illustrated in FIG. 8. As illustrated in FIG. 10, the calibration reference voltage selector 157 may include a division voltage generator 161 and a multiplexer 163.

The division voltage generator 161 may include a comparator 165, a driving device 167, and resistors 169_1~169_N. The comparator 165 may compare a reference voltage VREF and a third division voltage VDIV3. The driving device 167 may drive a node n16 based on an output signal of the comparator 165. The driving device 167 may drive the node n16 to a power voltage VDD when the third division voltage VDIV3 has a lower level than the reference voltage VREF. The resistors 169_1~169_N may divide the voltage of the node n16 to generate first to $N^{th}$ division voltages VDIV1~VDIVN. The first to $N^{th}$ division voltages VDIV1~VDIVN generated through the resistors 169_1~169_N may be set such that the first division voltage VDIV1 has the largest level and the $N^{th}$ division voltage VDIVN has the smallest level according to the voltage division rule. In the present embodiment, the comparator 165 compares the reference voltage VREF and the third division voltage VDIV3, but this is only an example and the comparator 165 may be implemented to compare the reference voltage VREF with one of the other division voltages VDIV1 to VDIV2 and VDIV4 to VDIVN.

The multiplexer 163 may receive the first to $N^{th}$ division voltages VDIV1~VDIVN generated through the resistors 169_1~169_N. The multiplexer 163 may select and output one of the first to $N^{th}$ division voltages VDIV1~VDIVN as a calibration reference voltage CVREF based on a calibration code CCD. The multiplexer 163 may select and output a division voltage having a higher level among the first to $N^{th}$ division voltages VDIV1~VDIVN as the calibration reference voltage CVREF, as the calibration code value set by the calibration code CCD increases. The multiplexer 163 may select and output a division voltage having a lower level among the first to $N^{th}$ division voltages VDIV1~VDIVN as the calibration reference voltage CVREF, as the calibration code value set by the calibration code CCD decreases.

Figure 12:
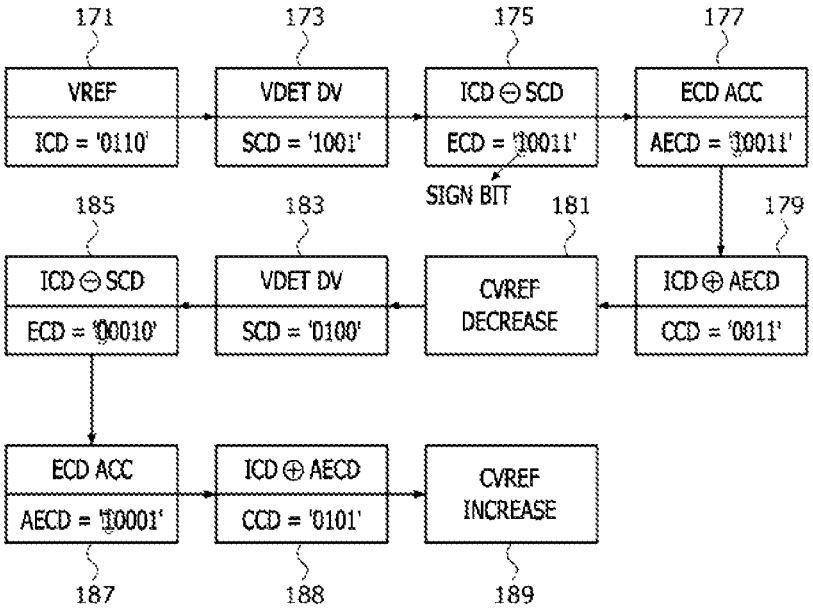

FIGS. 11 and 12 are diagrams illustrating an operation of the calibration reference voltage generator 151 illustrated in FIGS. 8 to 10.

Referring to FIGS. 8 and 11, the set code value of the set code SCD generated by the set code generator 151 may be checked. When the number of times the detection voltage VDET is generated to have a logic "high" level in synchronization with the rising edge of the clock CLK during the 15 periods of the clock CLK is defined as the set code value VDET DV, the bit combination of the set code SCD is set according to the set code value VDET DV. For example, the set code SCD is set to have bit combination '0000' when the set code value VDET DV is '0', is set to have bit combination '0001' when the set code value VDET DV is '1', and is set to have bit combination '0010' when the set code value VDET DV is '2'. Similarly, the set code SCD is set to have bit combination '1110' when the set code value VDET DV is '14', and is set to have bit combination '1111' when the set code value VDET DV is '15'.

The operation of the calibration reference voltage generator 133 will be described with reference to FIGS. 8, 9, 11, and 12.

First, in the state (171) that an initial code ICD for setting an initial level of a reference voltage VREF has bit combination '0110' corresponding to initial code value '6', when the set code value VDET DV is '9', in the set code generator 151, the set code SCD having bit combination '1001' corresponding to set code value '9' is generated (173).

Next, in the error code generator 153, an error code ECD having bit combination '10011' corresponding to error code value '-3' generated by subtracting set code value '9' of the set code SCD from the initial code value '6' set by the initial code ICD is generated (175).

Next, in the accumulator 1551 included in the calibration code generator 155, an accumulation error code AECD having bit combination '10011' corresponding to accumulation error code value '−3' calculated by adding error code value '−3' to initial accumulated error code value '0' is generated (177).

Next, in the adder 1551 included in the calibration code generator 155, a calibration code CCD having bit combination '0011' corresponding to calibration code value '3' calculated by adding accumulation error code value '−3' set by the accumulation error code AECD to the initial code value '6' set by the initial code ICD is generated (179).

Next, in the calibration reference voltage selector 157, a calibration reference voltage CVREF whose level is decreased from the initial level of the reference voltage VREF by the calibration code CCD having bit combination '0011' corresponding to calibration code value '3' is generated (181).

Next, when the set code value VDET DV is changed to '4', in the set code generator 151, a set code SCD having bit combination '0100' corresponding to the set code value '4' is generated (183).

Next, in the error code generator 153, an error code ECD having bit combination '00010' corresponding to error code value '2' generated by subtracting set code value '4' of the set code SCD from the initial code value '6' set by the initial code ICD is generate (185).

Next, in the accumulator 1551 included in the calibration code generator 155, an accumulation error code AECD having a bit combination '10001' corresponding to accumulation error code value '−1' calculated by adding error code value '2' to accumulation error code value '−3' is generated (187).

Next, in the adder 1553 included in the calibration code generator 155, a calibration code CCD having bit combination '0101' corresponding to calibration code value '5' calculated by adding accumulation error code value '−1' set by the accumulation error code AECD to initial code value '6' set by the initial code ICD is generated (188).

Next, in the calibration reference voltage selector 157, a calibration reference voltage CVREF whose level is increased compared to the previously calibrated calibration reference voltage CVREF by the calibration code CCD having bit combination '0101' corresponding to calibration code value '5' is generated (189).

The voltage generation circuit 1 configured as described above adjusts the level of a calibration reference voltage CVREF used to drive an operation voltage VP based on a set value calculated from a feedback voltage FBV generated based on the operating voltage VP, so that the level of the operation voltage VP may be stably maintained even if the load resistance value of a supply terminal to which the power voltage VDD or the operation voltage VP is supplied changes. More specifically, the voltage generation circuit 1 generates the calibration reference voltage CVREF whose level is decreased when the level of the operation voltage VP is increased by the influence of the power voltage VDD or a load resistance value, thereby reducing the level of the operation voltage VP. In addition, the voltage generating circuit 1 generates a calibration reference voltage CVREF whose level is increased when the level of the operation voltage VP is decreased by the influence of the power voltage VDD or the load resistance value, thereby increasing the level of the operation voltage VP.

Figure 13:
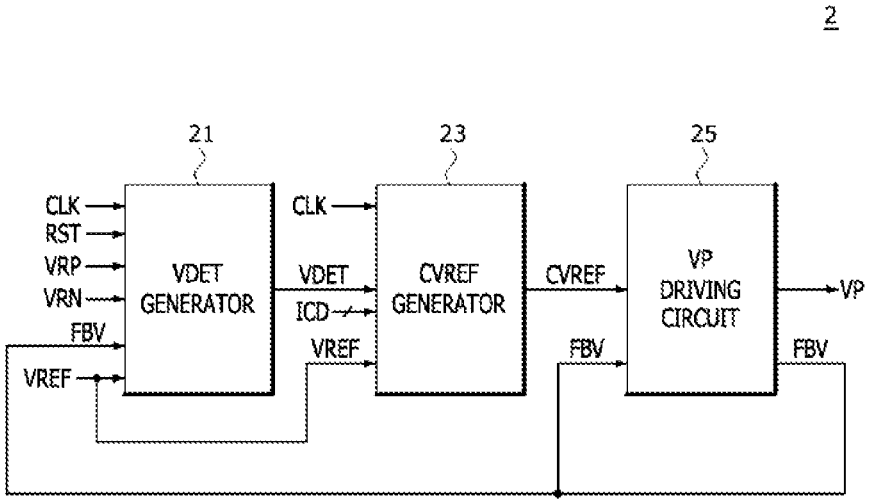
FIG. 13 is a block diagram illustrating a configuration of a voltage generation circuit according to another embodiment of the present disclosure.

FIG. 13 is a block diagram illustrating a configuration of a voltage generation circuit 2 according to another embodiment of the present disclosure. As illustrated in FIG. 13, the voltage generation circuit 2 may include a detection voltage generator (VDET GENERATOR) 21, a calibration reference voltage generator (CVREF GENERATOR) 23, and an operation voltage driving circuit (VP DRIVING CIRCUIT) 25.

The detection voltage generator 21 may generate a detection voltage VDET based on a clock CLK, a reset signal RST, an upper limit reference voltage VRP, a lower limit reference voltage VPN, a feedback voltage FBV, and a reference voltage VREF. The detection voltage generator 21 may generate an initial voltage (VINT of FIG. 14) whose level is variable according to the time-integrated value of the level difference between the feedback voltage FBV and the reference voltage VREF and may compare the reference voltage VREF and the initial voltage VINT based on the clock CLK to generate the detection voltage VDET. The detection voltage generator 21 may adjust the level of the initial voltage (VINT of FIG. 14) based on the detection voltage VDET and the reset signal RST. The detection voltage generator 21 may discharge the charge of a capacitor (231 of FIG. 14) included therein when the reset signal RST is activated and may set the level of the initial voltage VINT to the same level as the reference voltage VREF. The reset signal RST may be activated for an initialization operation. The detection voltage generator 21 may reduce the level of the initial voltage VINT according to a value obtained by time-integrating the level difference between the upper limit reference voltage VRP and the reference voltage VREF when the level of the initial voltage VINT increases and the detection voltage VDET is set to a first logic level. The upper limit reference voltage VRP may be set to have a greater level than the reference voltage VREF. The detection voltage generator 21 may increase the level of the initial voltage VINT according to a value obtained by time-integrating the level difference between the lower limit reference voltage VRN and the reference voltage VREF when the level of the initial voltage VINT decreases and the detection voltage VDET is set to have a second logic level. The lower limit reference voltage VRN may be set to have a greater level than the reference voltage VREF. In the present embodiment, the first logic level may be set to a logic "low" level, and the second logic level may be set to a logic "high" level. However, this is only an embodiment, and may be set differently depending on the embodiment.

The calibration reference voltage generator 23 may receive the detection voltage VDET from the detection voltage generator 21. The calibration reference voltage generator 23 may generate a calibration reference voltage CVREF based on the clock CLK, the detection voltage VDET, the reference voltage VREF, and an initial code ICD. The calibration reference voltage generator 23 may generate the calibration reference voltage CVREF whose level is decreased when the number of times that the detection voltage VDET is generated to a preset logic level increases during a period set by the clock CLK. The calibration reference voltage generator 23 may generate the calibration reference voltage CVREF whose level is increased when the number of times that the detection voltage VDET is generated to a preset logic level decreases during the period set by the clock CLK. Because the calibration reference voltage generator 23 may be implemented in the same manner as the calibration reference voltage generator 133 described with reference to FIGS. 8 to 12, a detailed description of configuration and operation thereof will be omitted.

The operation voltage driving circuit 25 may drive an operation voltage based on the calibration reference voltage CVREF and the feedback voltage FBV. The operation voltage driving circuit 25 may generate an oscillating signal OSC that toggles when the feedback voltage FBV is at a lower level than the calibration reference voltage CVREF and may pump the operation voltage VP to a higher level than the power voltage VDD or pump to a lower level than a ground voltage VSS using capacitor coupling caused when the oscillating signal OSC toggles. Because the operation voltage driving circuit 25 may be implemented in the same manner as the operation voltage driving circuit 11 illustrated in FIG. 1, a detailed description of configuration and operation thereof will be omitted.

Figure 14:
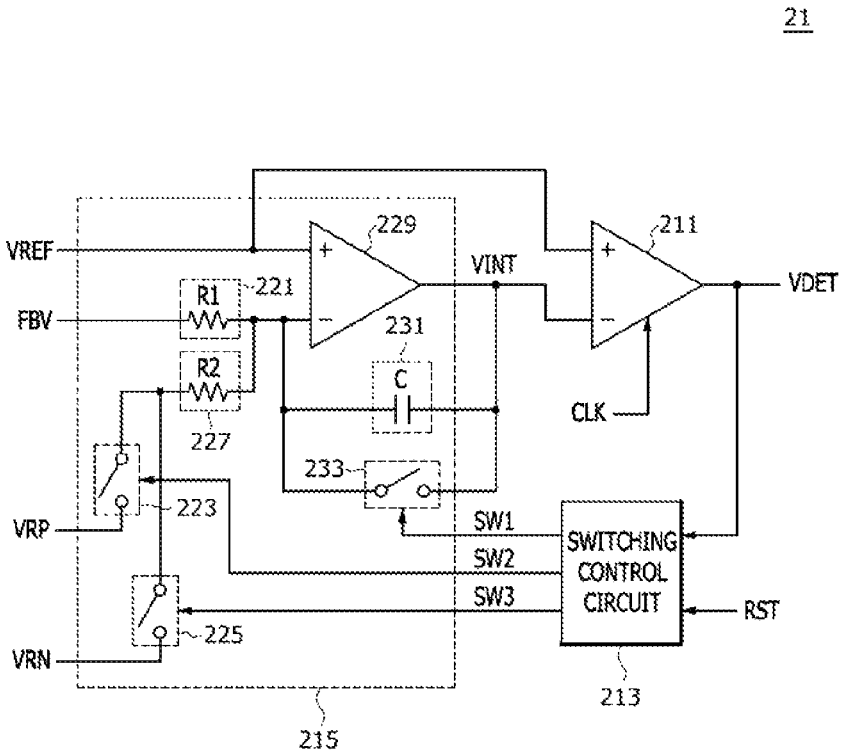
FIG. 14 is a circuit diagram, according to an embodiment, of a detection voltage generator included in the voltage generation circuit illustrated in FIG. 13.

FIG. 14 is a circuit diagram, according to an embodiment, of the detection voltage generator 21 illustrated in FIG. 13. As illustrated in FIG. 14, the detection voltage generator 21 may include a detection voltage driver 211, a switching control circuit 213, and an initial voltage generator 215.

The detection voltage driver 211 may compare a reference voltage VREF and an initial voltage VINT based on a clock CLK to drive a detection voltage VDET. The detection voltage driver 211 may generate the detection voltage VDET that is driven to have a logic "low" level when the initial voltage VINT has a level of a reference voltage VREF or higher in synchronization with a rising edge of the clock CLK. The detection voltage driver 211 may generate the detection voltage VDET that is driven to a logic "high" level when the initial voltage VINT has a lower level than the reference voltage VREF in synchronization with the rising edge of the clock CLK. The detection voltage driver 211 may be implemented with an OP AMP.

The switching control circuit 213 may receive the detection voltage VDET from the detection voltage driver 211. The switching control circuit 213 may generate a first switching signal SW1, a second switching signal SW2, and a third switching signal SW3 based on the detection voltage VDET and a reset signal RST. The switching control circuit 213 may generate the first switching signal SW1 that is activated to turn on a discharge switch 233 when the reset signal RST is activated for an initialization operation. The switching control circuit 213 may generate the second switching signal SW2 that is activated to turn on an upper limit switch 223 when the level of the initial voltage VINT increases and the detection voltage VDET is set to have a first logic level. The switching control circuit 213 may generate the third switching signal SW3 that is activated to turn on a lower limit switch 225 when the level of the initial voltage VINT decreases and the detection voltage VDET is set to have a second logic level.

The initial voltage generator 215 may receive the first switching signal SW1, the second switching signal SW2, and the third switching signal SW3 from the switching control circuit 213. The initial voltage generator 215 may include a first resistor 221, the upper limit switch 223, the lower limit switch 225, a second resistor 227, an initial voltage driver 229, a capacitor 231, and the discharge switch 233. The first resistor 221 and the second resistor 227 may be connected in parallel to a negative (−) input terminal of the initial voltage driver 229. The first resistor 221 may be set to have a resistance R1. The second resistor 227 may be set to have a resistance R2. The upper limit switch 223 may be connected to an upper limit reference voltage VRP and may be turned on when the second switching signal SW2 is activated to input an upper limit reference voltage VRP to the negative (−) input terminal of the initial voltage driver 229 through the second resistor 227. The lower limit switch 225 may be connected to a lower limit reference voltage VRN and may be turned on when the third switching signal SW3 is activated to input the lower limit reference voltage VRN to the negative (−) input terminal of the initial voltage driver 229 through the second resistor 227. The initial voltage driver 229 may receive a reference voltage VREF through a positive (+) input terminal thereof. The capacitor 231 may be connected between the negative (−) input terminal of the initial voltage driver 229 and an output terminal of the initial voltage driver 229 and may be set to have a capacitance C. The discharge switch 233 may be connected between the negative (−) input terminal of the initial voltage driver 229 and the output terminal of the initial voltage driver 299 and may be turned on when the first switching signal SW1 is activated to discharge charges accumulated in the capacitor 231.

The initial voltage generator 215 may generate an initial voltage VINT whose level is variable according to a first set value calculated based on the reference voltage VREF and the feedback voltage FBV. The first set value may be set to a value obtained by multiplying a value obtained by subtracting the level of the reference voltage VREF from the level of the feedback voltage FBV by the reciprocal of the first time constant. The first time constant may be set to a value obtained by multiplying the first resistance R1 of the first resistor 221 by the capacitance C of the capacitor 231. The initial voltage generator 215 may generate the initial voltage VINT whose level increases when the first set value has a negative (−) value. The initial voltage generator 215 may generate the initial voltage VINT whose level decreases when the first set value has a positive (+) value.

The initial voltage generator 215 may reduce the level of the initial voltage VINT according to a second set value calculated based on the upper limit reference voltage VRP and the reference voltage VREF when the level of the initial voltage VINT increases and the detection voltage VDET is set to have the first logic level. The second set value may be set to a value obtained by multiplying a value obtained by time-integrating the level difference between the upper limit reference voltage VRP and the reference voltage VREF by a reciprocal number of the second time constant of the initial voltage driver 229. The second time constant may be set to a value obtained by multiplying the second resistance R2 of the second resistor 227 by the capacitance C of the capacitor 231.

The initial voltage generator 215 may increase the level of the initial voltage VINT according to a third set value calculated based on the lower limit reference voltage VRN and the reference voltage VREF when the level of the initial voltage VINT decreases and the detection voltage VDET is set to have the second logic level. The third set value may be set to a value obtained by multiplying a value obtained by time-integrating the level difference between the lower limit reference voltage VRN and the reference voltage VREF by a reciprocal number of the second time constant of the initial voltage driver 229.

FIGS. 15 to 17 are diagrams illustrating an operation of the voltage generation circuit 2 illustrated in FIGS. 13 and 14. Referring to FIGS. 15 to 17, the operation of the voltage generation circuit 2 proceeds as follows.

Referring to FIG. 15, the equation of the initial voltage VINT generated by the initial voltage generator 215 may be checked. As illustrated in Equation1 of FIG. 15, the initial voltage VINT may be set to a value obtained by subtracting the first set value and the second set value from the reference voltage VREF when the level of the initial voltage VINT increases. The first set value of the initial voltage generator 215 may be set to a value obtained by multiplying a value $\int(FBV-VREF)dt$ obtained by time-integrating a value obtained by subtracting the level of the reference voltage VREF from the level of the feedback voltage FBV, by the reciprocal of the first time constant $R_1C$. The second set value of the initial voltage generator 215 may be set to a value obtained by multiplying a value $\int(VRP-VREF)dt$ obtained by time-integrating a value obtained by subtracting the level of the reference voltage VREF from the level of the upper limit reference voltage VRP, by the reciprocal of the second time constant $R_2C$. As illustrated in Equation 2 of FIG. 15, the initial voltage VINT may be set to a value obtained by subtracting the first set value and the third set value from the reference voltage VREF when the level of the initial voltage VINT decreases. The third set value of the initial voltage generator 215 may be set to a value obtained by multiplying a value $\int(VRP-VREF)dt$ obtained by time-integrating a value obtained by subtracting the level of the reference voltage VREF from the level of the lower limit reference voltage VRN, by the reciprocal 1/R2C of the second time constant.

Referring to FIG. 16, the level change of the initial voltage VINT according to the first set value of the initial voltage generator 215 may be checked. As illustrated in FIG. 16, when the first set value of the initial voltage generator 215 has a negative (−) value, the level of the initial voltage VINT increases, and when the first set value of the initial voltage generator 215 has a positive (+) value, the level of the initial voltage VINT decreases.

Referring to FIG. 17, the operation of the initial voltage generator 215 will be divided into cases in which the first switching signal SW1, the second switching signal SW2, and the third switching signal SW3 are respectively activated as follows. When the reset signal RST is activated to a logic "high" level for an initialization operation, the first switching signal SW1 is activated to a logic "high" level to discharge charges accumulated in the capacitor 231. In addition, when the level of the initial voltage VINT is increased and the detection voltage VDET is set to have a logic "low" level, the second switching signal SW2 is activated to a logic "high" level to decrease the level of the initial voltage VINT. Meanwhile, when the level of the initial voltage VINT is decreased and the detection voltage VDET is set to have a logic "high" level, the third switching signal SW3 is activated to a logic "high" level to increase the level of the initial voltage VINT.

The initial voltage generating circuit 2 configured as described above adjusts the level of the calibration reference voltage CVREF used to drive the operation voltage VP based on the set values calculated from the feedback voltage FBV, the upper limit reference voltage VRP, and the lower limit reference voltage VRN generated based on the operation voltage VP, so that the level of the operation voltage VP may be stably maintained even if the load resistance value of the supply terminal to which the power voltage VDD or the operation voltage VP is supplied changes. More specifically, the initial voltage generation circuit 2 may reduce the level of the operation voltage VP by generating a calibration reference voltage CVREF whose level is decreased when the level of the operation voltage VP is increased by the influence of the power voltage VDD or the load resistance value, and may increase the level of the operation voltage VP by generating a calibration reference voltage CVREF whose level is increased when the level of the operating voltage VP is decreased by the influence of the power voltage VDD or the load resistance value.

Figure 18:
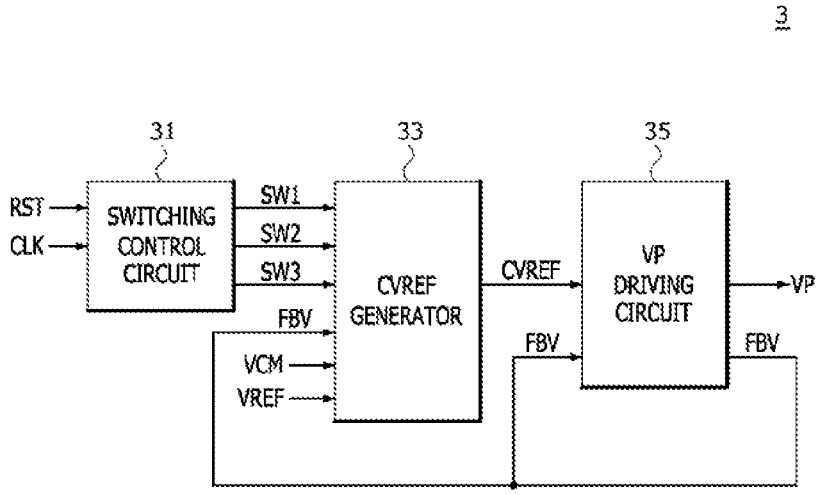
FIG. 18 is a block diagram illustrating a configuration of a voltage generation circuit, according to another embodiment of the present disclosure.

FIG. 18 is a block diagram illustrating a configuration of a voltage generation circuit 3 according to another embodiment of the present disclosure. As illustrated in FIG. 18, the voltage generation circuit 3 may include a switching control circuit (SWITCHING CONTROL CIRCUIT) 31, a calibration reference voltage generator (CVREF GENERATOR) 33, and an operation voltage driving circuit (VP DRIVING CIRCUIT) 35.

The switching control circuit 31 may generate a first switching signal SW1, a second switching signal SW2, and a third switching signal SW3 based on a reset signal RST and a clock CLK. The switching control circuit 31 may generate the first switching signal SW1 that is activated to turn on a discharge switch (355 of FIG. 19) when the reset signal RST is activated for an initialization operation. The switching control circuit 31 may generate the second switching signal SW2 and the third switching signal SW3 that toggle in synchronization with the clock CLK after the initialization operation is completed and the first switching signal SW1 is deactivated. For example, the switching control circuit 31 may generate the first switching signal SW1 that toggles in the same phase as the clock CLK after the initialization operation is completed, and may generate the second switching signal SW2 that toggles in an opposite phase to the clock CLK. In the present embodiment, the first switching signal SW1 and the second switching signal SW2 are generated with the same cycle as the clock CLK, but this is only an embodiment and the first switching signal SW1 and the second switching signal SW2 may be generated with different cycles depending on the embodiment.

The calibration reference voltage generator 33 may receive the first switching signal SW1, the second switching signal SW2, and the third switching signal SW3 from the switching control circuit 31. The calibration reference voltage generator 33 may generate a calibration reference voltage CVREF based on the first switching signal SW1, the second switching signal SW2, the third switching signal SW3, a feedback voltage FBV, a set voltage VCM, and a reference voltage VREF. The set voltage VCM may be set to have the same level as the reference voltage VREF. The calibration reference voltage generator 33 may discharge charges of a third capacitor (353 of FIG. 19) when the reset signal RST is activated for the initialization operation. The calibration reference voltage generator 33 may switch a first capacitor (335 in FIG. 19) and a second capacitor (345 in FIG. 19) by the second switching signal SW2 and the third switching signal SW3, respectively, toggling in opposite phases to each other. The calibration reference voltage generator 33 may generate the calibration reference voltage CVREF set according to a time-integrated value of the level difference between the feedback voltage FBV and the reference voltage VREF by the switched first and second capacitors 335 and 345. The calibration reference voltage generator 33 may generate the calibration reference voltage CVREF whose level is decreased during a period in which the level of the feedback voltage FBV increases to be higher than or equal to the level of the reference voltage VREF. The calibration reference voltage generator 33 may generate the calibration reference voltage CVREF whose level is increased during a period in which the level of the feedback voltage FBV is decreased to less than the level of the reference voltage VREF.

The operation voltage driving circuit 35 may drive an operation voltage VP based on the calibration reference voltage CVREF and the feedback voltage FBV. The operation voltage driving circuit 35 may generate an oscillating signal OSC toggling when the feedback voltage FBV is at a lower level than the calibration reference voltage CVREF, and may pump the operation voltage VP to a higher level than the power voltage VDD or to a lower level than the ground voltage VSS using the coupling of the capacitor caused when the oscillating signal OSC toggles. Because the operation voltage driving circuit 35 may be implemented in the same manner as the operation voltage driving circuit 11 illustrated in FIG. 1, a detailed description of the configuration and operation will be omitted.

Figure 19:
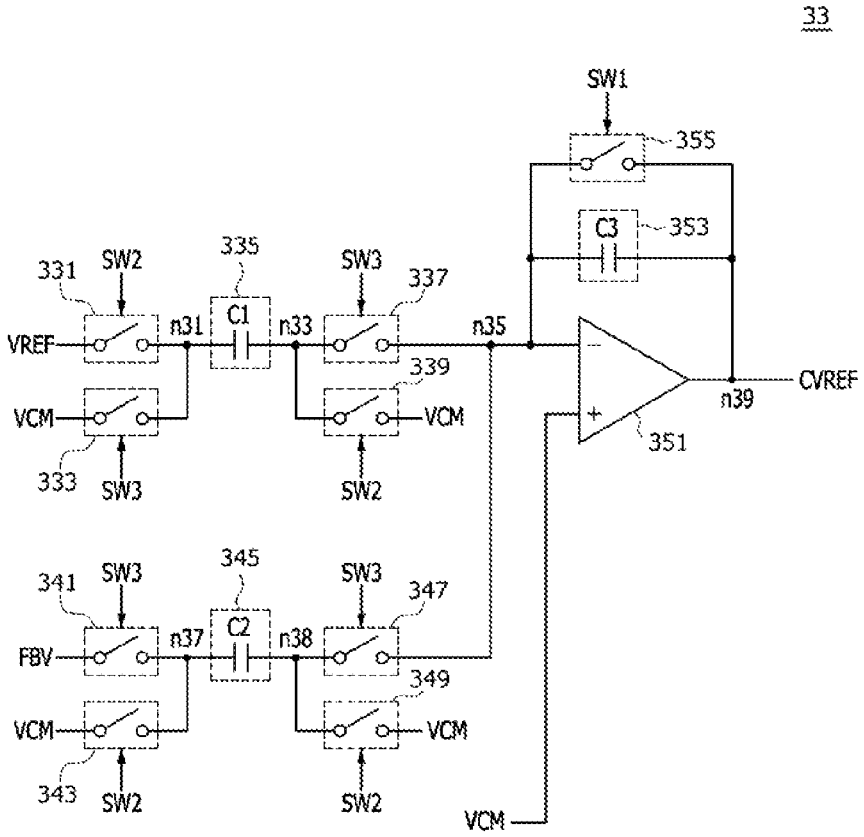
FIG. 19 is a circuit diagram, according to an embodiment, of a calibration reference voltage generator included in the voltage generation circuit illustrated in FIG. 18.

FIG. 19 is a circuit diagram, according to an embodiment, of the calibration reference voltage generator 33 illustrated in FIG. 18. As illustrated in FIG. 19, the calibration reference voltage generator 33 may include a first switch 331, a second switch 333, a first capacitor 335, a third switch 337, a fourth switch 339, a fifth switch 341, a sixth switch 343, a second capacitor 345, a seventh switch 347, an eighth switch 349, an amplifier 351, a third capacitor 353, and a discharge switch 355. The first switch 331 may be connected between a reference voltage VREF and a node n31 to be turned on when a second switching signal SW2 is activated. The second switch 333 may be connected between a set voltage VCM and the node n31 to be turned on when a third switching signal SW3 is activated. The first capacitor 335 may be connected between the node n31 and a node n33. The third switch 337 may be connected between the node n33 and a node n35 to be turned on when a third switching signal SW3 is activated. The fourth switch 339 may be connected between the node n33 and the set voltage VCM to be turned on when the second switching signal SW2 is activated. The fifth switch 341 may be connected between a feedback voltage FBV and a node n37 to be turned on when the third switching signal SW3 is activated. The sixth switch 343 may be connected between the set voltage VCM and the node n37 to be turned on when the second switching signal SW2 is activated. The second capacitor 345 may be connected between the node n37 and a node n38. In the present embodiment, the capacitance C1 of the first capacitor 335 and the capacitance C2 of the second capacitor 345 may be set to be the same, but this is only an example and the capacitance C1 of the first capacitor 335 and the capacitance C2 of the second capacitor 345 may be set differently depending on the embodiment. The seventh switch 347 may be connected between the node n38 and the node n35 to be turned on when the third switching signal SW3 is activated. The eighth switch 349 may be connected between the node n38 and the set voltage VCM to be turned on when the second switching signal SW2 is activated. A negative (–) input terminal of the amplifier 351 may be connected to the node n35, and a positive (+) input terminal of the amplifier 351 may be connected to the set voltage VCM. The third capacitor 353 may be connected between the node n35 and a node n39 from which a calibration reference voltage CVREF is output. The capacitance C3 of the third capacitor 353 may be set to K times the capacitance C1 of the first capacitor 335 or the capacitance C2 of the second capacitor 345. The discharge switch 355 may be connected between the node n35 and a node n39 to be turned on when the first switching signal SW1 is activated to discharge charges of the third capacitor 353.

FIGS. 20 to 24 are diagrams illustrating an operation of the voltage generation circuit 33 illustrated in FIGS. 18 and 19. The operation of the calibration reference voltage generator 33 illustrated in FIG. 19 will be described for the operation of the voltage generation circuit 33, a case in which a reset operation is performed to activate a first switching signal SW1 to a logic "high" level, a case in which a second switching signal SW2 is activated to a logic "high" level, and a case in which a third switching signal SW3 is activated to a logic "high" level will be described.

Figure 20:
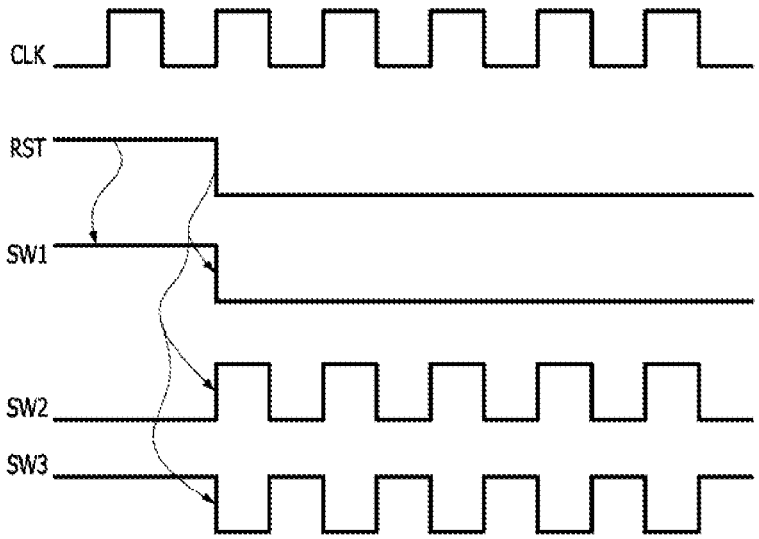
FIGS. 20 to 24 are diagrams illustrating an operation of the voltage generation circuit illustrated in FIGS. 18 and 19.

As illustrated in FIGS. 19 and 20, the first switching signal SW1 is activated to a logic "high" level during a period in which a reset signal RST of a logic "high" level is input for a reset operation. When the reset operation is finished and the reset signal RST transitions from the logic "high" level to a logic "low" level, the first switching signal SW1 is deactivated to a logic "low" level, and the second switching signal SW2 and the third switching signal SW3 are toggled in synchronization with a clock CLK. The second switching signal SW2 is set to have the same cycle as the clock CLK and to have the same phase as the clock CLK. The third switching signal SW3 is set to have the same cycle as the clock CLK and to have a phase opposite to that of the clock CLK. For example, the third switching signal SW3 is 180 degrees out of phase with the second switching signal SW2.

Figure 21:
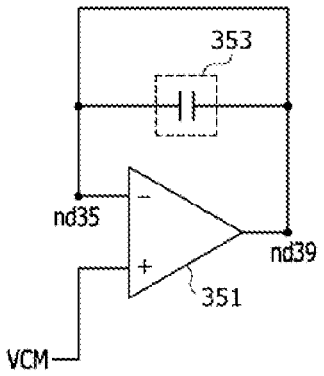

As illustrated in FIGS. 19 and 21, during a period in which the first switching signal SW1 is activated to a logic "high" level, the discharge switch 355 is turned on and the node n35 and the node n39 are short-circuited, so that charges of the third capacitor 353 is discharged.

Figure 22:
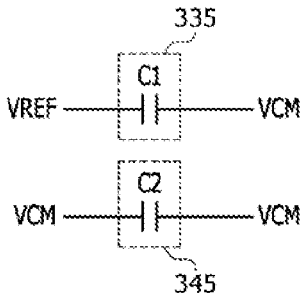

As illustrated in FIGS. 19 and 22, when the second switching signal SW2 is activated to a logic "high" level, the first switch 331, the fourth switch 339, the sixth switch 343, and the eighth switch 349 are turned on, so that a reference voltage VREF and a set voltage VCM are connected to both terminals of the first capacitor 335, and the set voltage VCM is connected to both terminals of the second capacitor 345. The first capacitor 335 is charged with a charge having a value obtained by multiplying the difference between the reference voltage VREF and the set voltage VCM by the capacitance C1 as the first charge amount. No charge is charged in the second capacitor 345.

Figure 23:
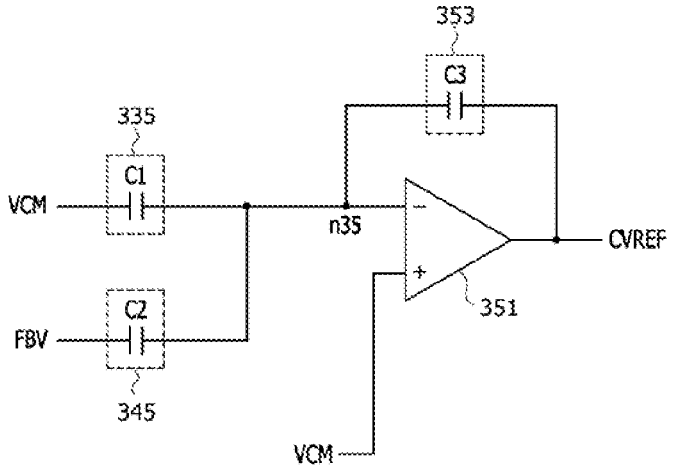

As illustrated in FIGS. 19 and 23, because the second switch 333, the third switch 337, the fifth switch 341, and the seventh switch 347 are turned on when the third switching signal SW3 is activated to a logic "high" level, the first capacitor 335 is connected to the set voltage VCM and the node n35, and because the node n35 connected to a negative input terminal of the amplifier 351 is set to the set voltage VCM input to a positive input terminal of the amplifier 351, no charge is charged in the first capacitor 335. However, when the second switching signal SW2 is at a logic "high" level, the first amount of charges charged in the first capacitor 335 is charged in the third capacitor 353. Because the feedback voltage FBV and the node n35 are connected to both terminals of the second capacitor 345, the second capacitor 345 is charged with a charge having a value obtained by multiplying the difference between the feedback voltage FBV and the set voltage VCM by the capacitance C2 as the second amount of charge. Accordingly, the amount of charge charged in the third capacitor 353 is determined as a value obtained by subtracting the second amount of charge from the first amount of charge. Expressing this as an equation, C3(CVREF–VCM)=C1 (VREF–VCM)–C2 (VFB–VCM), when C1 and C2 are the same and C3 is K times C1, rearranging the equation, the calibration reference voltage CVREF is defined as $$VCM + \frac{1}{K} * (VREF - VFB).$$

$$VCM + \frac{1}{K} * (VREF - VFB)$$

is a value calculated when the second switching signal SW2 and the third switching signal SW3 toggle once, and as the second switching signal SW2 and the third switching signal SW3 toggle sequentially, the level of the calibration reference voltage CVREF is changed according to the set value of the calibration reference voltage generator 33 set according to the feedback voltage FBV and the reference voltage VREF. That is, the level of the calibration reference voltage CVREF decreases when the set value of the calibration reference voltage generator 33 increases, and increases when the set value of the calibration reference voltage generator 33 decreases.

Figure 24:
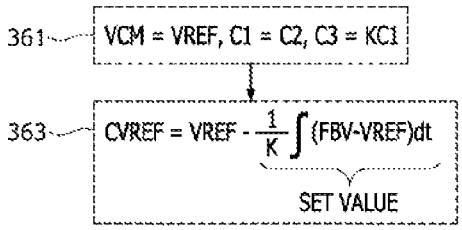

Referring to FIG. 24, when assuming that the set voltage VCM is set to be equal to the reference voltage VREF, the capacitance C1 of the first capacitor 335 and the capacitance C2 of the second capacitor 345 are the same, and the capacitance C3 of the third capacitor 353 is K times of C1 or C2 (361), equation $$CVREF = VREF - \frac{1}{K}\int(VFB - VREF)dt \quad (363)$$

of the calibration reference voltage CVREF may be confirmed. That is, when the second switching signal SW2 and the third switching signal SW3 are sequentially toggled, the calibration reference voltage CVREF may be calculated as a value obtained by subtracting the set value of the calibration reference voltage generator 33 from the reference voltage VREF.

The voltage generation circuit 3 configured as described above adjusts the level of the calibration reference voltage CVREF used to drive the operation voltage VP based on the set value calculated from the switching signal generated based on the clock CLK and the feedback voltage FBV generated based on the operation voltage VP, so that the level of the operation voltage VP may be stably maintained even if the load resistance value of a supply terminal to which the power voltage VDD or the operation voltage VP is supplied changes. More specifically, the voltage generation circuit 3 generates a calibration reference voltage CVREF whose level is decreased when the level of the operation voltage VP is increased by the influence of the power voltage VDD or the load resistance value, thereby reducing the level of the operation voltage VP. In addition, the voltage generating circuit 3 generates a calibration reference voltage CVREF whose level is increased when the level of the operation voltage VP is decreased by the influence of the power voltage VDD or the load resistance value, thereby increasing the level of the operation voltage VP.

Concepts have been disclosed in conjunction with some embodiments as described above. Those skilled in the art will appreciate that various modifications, additions, and substitutions are possible, without departing from the scope and spirit of the present disclosure. Accordingly, the embodiments disclosed in the present specification should be considered from not a restrictive standpoint but rather from an illustrative standpoint. The scope of the concepts is not limited to the above descriptions but defined by the accompanying claims, and all of distinctive features in the equivalent scope should be construed as being included in the concepts.

What is claimed is:

1. A voltage generation circuit comprising:

an operation voltage driving circuit configured to drive an operation voltage based on a calibration reference voltage and a feedback voltage and generate the feedback voltage from the operation voltage; and a reference voltage calibration circuit configured to generate the calibration reference voltage, wherein the calibration reference voltage varies based on a set value calculated according to the feedback voltage and a reference voltage, wherein the reference voltage calibration circuit is configured to calculate the set value based on a value obtained by time-integrating a level difference between the feedback voltage and the reference voltage.

2. The voltage generation circuit of claim 1, wherein the operation voltage driving circuit is configured to drive the operation voltage when the feedback voltage has a lower level than the calibration reference voltage.

3. The voltage generation circuit of claim 1, wherein the feedback voltage is generated by dividing the operation voltage.

4. The voltage generation circuit of claim 1, wherein the reference voltage calibration circuit is configured to generate the calibration reference voltage whose level varies from an initial level of the reference voltage set based on an initial code.

5. The voltage generation circuit of claim 1, wherein the reference voltage calibration circuit is configured to set the set value to a value obtained by multiplying a result of time-integrating a level difference between the feedback voltage and the reference voltage by a reciprocal of a time constant.

6. The voltage generation circuit of claim 1, wherein the operation voltage driving circuit is configured to drive the operation voltage in synchronization with an oscillating signal, and the reference voltage calibration circuit is configured to generate the calibration reference voltage in synchronization with a clock, and wherein the clock is set to have a cycle N times greater than the oscillating signal, wherein N is a natural number equal to or greater than 2.

7. The voltage generation circuit of claim 1, wherein the reference voltage calibration circuit is configured to:

generate the calibration reference voltage whose level increases when the set value has a negative value; and generate the calibration reference voltage whose level decreases when the set value has a positive value.

8. The voltage generation circuit of claim 1, wherein the reference voltage calibration circuit includes:

a detection voltage generator configured to generate an initial voltage based on the set value and compare the reference voltage and the initial voltage based on a clock to generate a detection voltage; and a calibration reference voltage generator configured to generate the calibration reference voltage whose level varies according to a result of sensing the detection voltage based on the clock.

9. The voltage generation circuit of claim 8, wherein the detection voltage generator is configured to:

generate the initial voltage whose level increases when the set value has a negative value; and generate the initial voltage whose level decreases when the set value has a positive value.

10. The voltage generation circuit of claim 8, wherein, when the initial voltage has a higher level than the reference voltage, the detection voltage has a first logic level, and wherein, when the initial voltage has a lower level than the reference voltage, the detection voltage has a second logic level.

11. The voltage generation circuit of claim 10, wherein the calibration reference voltage generator is configured to:

generate the calibration reference voltage whose level increases as the number of times that the detection voltage generated in synchronization with the clock is generated to have the second logic level decreases during a preset period of the clock, and generate the calibration reference voltage whose level is decreased as the number of times that the detection voltage generated in synchronization with the clock is generated to have the second logic level increases during a preset period of the clock.

12. The voltage generation circuit of claim 8, wherein the detection voltage generator includes:

an initial voltage driver configured to receive the reference voltage and the feedback voltage to drive an initial voltage based on the set value; and a detection voltage driver configured to compare the reference voltage with the initial voltage based on the clock to generate the detection voltage.

13. The voltage generation circuit of claim 12, further comprising:

a resistor connected to a negative input terminal of the initial voltage driver; and a capacitor connected between the negative input terminal of the initial voltage driver and an output terminal of the initial voltage driver.

14. The voltage generation circuit of claim 13, wherein the set value is set to a value obtained by multiplying a result of time-integrating a level difference between the feedback voltage and the reference voltage by a reciprocal of a time constant, and wherein the time constant is set to a value obtained by multiplying a resistance of the resistor and a capacitance of the capacitor.

15. The voltage generation circuit of claim 12, wherein each of the initial voltage driver and the detection voltage driver is implemented with an operational amplifier (OP AMP).

16. The voltage generation circuit of claim 8, wherein the calibration reference voltage generator includes:

a set code generator configured to sense a level of the detection voltage based on the clock to generate a set code;

an error code generator configured to generate an error code based on the set code and an initial code;

a calibration code generator configured to generate a calibration code based on the error code and the initial code; and a calibration reference voltage selector configured to calibrate a level of the reference voltage based on the calibration code to generate the calibration reference voltage.

17. The voltage generation circuit of claim 16, wherein the set code generator generates the set code whose bit combination is set based on the number of times that the detection voltage generated in synchronization with the clock is generated at a preset logic level during a preset period of the clock.

18. The voltage generation circuit of claim 16, wherein the error code generator is capable of generating the error code having a bit combination corresponding to an error code value that is generated by subtracting a set code value set by the set code from an initial code value of the initial code.

19. The voltage generation circuit of claim 18, wherein the initial code value of the initial code is set to have a bit combination corresponding to an initial level of the reference voltage.

20. The voltage generation circuit of claim 16, wherein the calibration code generator is configured to:

accumulate and store the error code values of the error codes that are sequentially input; and generate the calibration code having a bit combination corresponding to the calibration code value generated by adding the accumulated error code values to the initial code value of the initial code.

21. The voltage generation circuit of claim 20, wherein the calibration code generator includes:

an accumulator configured to accumulate the error code values of the error code to generate an accumulation error code having a bit combination corresponding to the accumulation error code value; and an adder configured to add the accumulation error code value of the accumulation error code to the initial code value of the initial code to generate the calibration code.

22. The voltage generation circuit of claim 16, wherein the calibration reference voltage selector is configured to:

select a division voltage having a higher level among a plurality of division voltages generated based on the reference voltage as the calibration reference voltage, as the calibration code value of the calibration code increases; and select a division voltage having a lower level among the plurality of division voltages as the calibration reference voltage, as the calibration code value of the calibration code decreases.

23. The voltage generation circuit of claim 16, wherein the calibration reference voltage selector includes:

a division voltage generator configured to generate the plurality of division voltages by dividing a voltage of a node and compare one of the plurality of division voltages with the reference voltage to drive the node; and a multiplexer configured to select and output one of the division voltages as the calibration reference voltage based on the calibration code.

24. A voltage generation circuit comprising:

an operation voltage driving circuit configured to drive an operation voltage based on a calibration reference voltage and a feedback voltage and generate the feedback voltage from the operation voltage; and a reference voltage calibration circuit configured to compare the feedback voltage with a reference voltage in synchronization with a clock to generate a detection voltage and generate the calibration reference voltage from the detection voltage and the reference voltage in response to an initial code.

25. The voltage generation circuit of claim 24, wherein the reference voltage calibration circuit is configured to generate the calibration reference voltage, wherein the calibration reference voltage varies based on the number of times that the detection voltage generated in synchronization with the clock is generated at a preset logic level during a preset period of the clock.

26. The voltage generation circuit of claim 24, wherein the reference voltage calibration circuit is configured to:

generate a set code from the detection voltage based on the clock;

generate an error code based on the set code and the initial code;

generate a calibration code based on the error code and the initial code; and generate the calibration reference voltage by calibrating a level of the reference voltage based on the calibration code.

27. A voltage generation circuit comprising:

an operation voltage driving circuit configured to drive an operation voltage based on a calibration reference voltage and a feedback voltage and generate the feedback voltage from the operation voltage;

a detection voltage generator configured to calculate a first set value based on a time-integrated value of the level difference between the feedback voltage and the reference voltage, calculate a second set value based on a time-integrated value of the level difference between an upper limit reference voltage and the reference voltage, calculate a third set value based on a time-integrated value of the level difference between a lower limit reference voltage and the reference voltage, and generate a detection voltage based on at least one of the first, second, and third set values; and a calibration reference voltage generator configured to generate the calibration reference voltage whose level varies according to a result of sensing the detection voltage based on a clock.

28. The voltage generation circuit of claim 27, wherein:

the upper limit reference voltage is set to have a higher level than the reference voltage; and the lower limit reference voltage is set to have a lower level than the reference voltage.

29. The voltage generation circuit of claim 27, wherein the detection voltage generator is configured to:

generate an initial voltage whose level increases when the first set value has a negative value; and generate an initial voltage whose level decreases when the first set value has a positive value.

30. The voltage generation circuit of claim 29, wherein the detection voltage generator is configured to:

generate the detection voltage having a first logic level when the initial voltage has a level higher than or equal to a level of the reference voltage based on the clock, and generate the detection voltage having a second logic level when the initial voltage has a level less than the reference voltage based on the clock.

31. The voltage generation circuit of claim 30, wherein the detection voltage generator is configured to:

decrease a level of the initial voltage according to the second set value when the detection voltage is set to have the first logic level; and increase a level of the initial voltage according to the third set value when the detection voltage is set to have the second logic level.

32. The voltage generation circuit of claim 27, wherein the detection voltage generator includes:

a detection voltage driver configured to compare the reference voltage and the initial voltage based on the clock to drive the detection voltage;

a switching control circuit configured to generate first, second, and third switching signals from the detection voltage and a reset signal; and an initial voltage generator configured to generate the initial voltage based on the first, second, and third switching signals and the first, second, and third set values.

33. The voltage generation circuit of claim 32, wherein the detection voltage driver is implemented with an operational amplifier (OP AMP).

34. The voltage generation circuit of claim 32, wherein the switching control circuit is capable of generating the first switching signal, wherein the first switching signal is activated when the reset signal is activated for an initialization operation.

35. The voltage generation circuit of claim 32, wherein the detection voltage driver is configured to:

generate the detection voltage which is driven to the first logic level when the initial voltage has a level higher than or equal to the level of the reference voltage in synchronization with a rising edge of the clock; and generate the detection voltage which is driven to the second logic level when the initial voltage has a level less than the level of the reference voltage in synchronization with the rising edge of the clock.

36. The voltage generation circuit of claim 35, wherein the switching control circuit is capable of:

generating the second switching signal, wherein the second switching signal is activated when the detection voltage has the first logic level, and generating the third switching signal, wherein the third switching signal is activated when the detection voltage has the second logic level.

37. The voltage generation circuit of claim 27, wherein the initial voltage generator includes an initial voltage driver configured to receive the reference voltage and the feedback voltage to drive the initial voltage based on the first, second, and third set values.

38. The voltage generation circuit of claim 37, wherein the initial voltage driver is implemented with an operational amplifier (OP AMP).

39. The voltage generation circuit of claim 37, wherein the initial voltage generator includes:

a first resistor connected between a negative input terminal of the initial voltage driver and the feedback voltage;

a capacitor connected between the negative input terminal of the initial voltage driver and an output terminal of the initial voltage driver;

a discharge switch connected between the negative input terminal of the initial voltage driver and the output terminal of the initial voltage driver and configured to be turned on based on the first switching signal;

a second resistor connected to the negative input terminal of the initial voltage driver;

an upper limit switch connected between the second resistor and the upper limit reference voltage and configured to be turned on based on the second switching signal, and a lower limit switch connected between the second resistor and the lower limit reference voltage and configured to be turned on based on the third switching signal.

40. The voltage generation circuit of claim 39, wherein:

the first set value is set to a value obtained by multiplying a value obtained by time-integrating a level difference between the feedback voltage and the reference voltage by a reciprocal of a first time constant; and the first time constant is set to a value obtained by multiplying a resistance of the first resistor by a capacitance of the capacitor.

41. The voltage generation circuit of claim 39, wherein:

the second set value is set as a value obtained by multiplying a value obtained by time-integrating a level difference between the upper limit reference voltage and the reference voltage by a reciprocal of a second time constant, and the second time constant is set to a value obtained by multiplying a resistance of the second resistor by the capacitance of the capacitor.

42. The voltage generation circuit of claim 39, wherein:

the third set value is set to a value obtained by multiplying a value obtained by time-integrating a level difference between the lower limit reference voltage and the reference voltage by the reciprocal of a second time constant, and the second time constant is set to a value obtained by multiplying the resistance of the second resistor by the capacitance of the capacitor.

43. The voltage generation circuit of claim 27, wherein the calibration reference voltage generator is configured to:

generate the calibration reference voltage whose level increases as the number of times that the detection voltage generated in synchronization with the clock is generated to a preset logic level decreases during a preset period of the clock, and generate the calibration reference voltage whose level decreases as the number of times that the detection voltage generated in synchronization with the clock is generated to a preset logic level increases during a preset period of the clock.

44. The voltage generation circuit of claim 27, wherein the calibration reference voltage generator includes:

a set code generator capable of sensing a level of the detection voltage based on the clock to generate a set code;

an error code generator capable of generating an error code based on the set code and an initial code;

a calibration code generator configured to generate a calibration code based on the error code and the initial code; and a calibration reference voltage selector configured to calibrate a level of the reference voltage based on the calibration code to generate the calibration reference voltage.

45. A voltage generation circuit comprising:

a switching control circuit configured to generate a first switching signal, a second switching signal, and a third switching signal based on a reset signal and a clock, an operation voltage driving circuit configured to drive an operation voltage based on a calibration reference voltage and a feedback voltage and generate the feedback voltage from the operation voltage, and a calibration reference voltage generator configured to receive the first switching signal, the second switching signal, and the third switching signal and generate the calibration reference voltage, wherein the calibration reference voltage varies based on a set value calculated from the feedback voltage and a reference voltage.

46. The voltage generation circuit of claim 45, wherein the switching control circuit is capable of generating the first switching signal, wherein the first switching signal is activated to discharge charges of a capacitor connected between an output terminal of an amplifier and a negative input terminal of the amplifier when the reset signal is activated for an initialization operation.

47. The voltage generation circuit of claim 46, wherein the switching control circuit is capable of generating the second switching signal and the third switching signal, wherein the second switching signal and the third switching signal toggle in synchronization with the clock after the initialization operation is finished.

48. The voltage generation circuit of claim 47, wherein the switching control circuit is capable of:

generating the first switching signal, wherein the first switching signal toggles in the same phase as the clock after the initialization operation is finished; and generating the second switching signal, wherein the second switching signal toggles in an opposite phase to the clock.

49. The voltage generation circuit of claim 45, wherein the calibration reference voltage generator includes a first capacitor and a second capacitor, wherein the first capacitor is connected between the reference voltage and a set voltage when the second switching signal is activated, and wherein both terminals of the second capacitor are connected to the set voltage when the second switching signal is activated.

50. The voltage generation circuit of claim 49, wherein the calibration reference voltage generator further includes an amplifier configured to:

receive a voltage of a node to which the first capacitor and the second capacitor are connected in parallel to a negative input terminal of the amplifier when the third switching signal is activated; and receive the set voltage to a positive input terminal of the amplifier to generate the calibration reference voltage.

51. The voltage generation circuit of claim 50, wherein the calibration reference voltage generator includes a first capacitor, a second capacitor, and a third capacitor, wherein the first capacitor is connected between the set voltage and a negative input terminal of the amplifier, wherein the second capacitor is connected between the feedback voltage and the negative input terminal of the amplifier, and wherein the third capacitor is connected between an output terminal of the amplifier and the negative input terminal of the amplifier.

52. The voltage generation circuit of claim 51, wherein the calibration reference voltage generator is configured to, when a first capacitance of the first capacitor is set to be equal to a second capacitance of the second capacitor and a third capacitance of the third capacitor is set to be K times the first capacitance, set a set value to a value obtained by dividing a value obtained by time-integrating a level difference between the feedback voltage and the reference voltage by K.

53. The voltage generation circuit of claim 45, wherein the calibration reference voltage generator includes:

a first switch connected between the reference voltage and a first node and configured to be turned on when the second switching signal is activated;

a second switch connected between a set voltage and the first node and configured to be turned on when the third switching signal is activated;

a first capacitor connected between the first node and a second node;

a third switch connected between the second node and a third node and configured to be turned on when the third switching signal is activated;

a fourth switch connected between the second node and the set voltage and configured to be turned on when the second switching signal is activated;

a fifth switch connected between the feedback voltage and a fourth node and configured to be turned on when the third switching signal is activated;

a sixth switch connected between the set voltage and the fourth node and configured to be turned on when the second switching signal is activated;

a second capacitor connected between the fourth node and a fifth node;

a seventh switch connected between the fifth node and a sixth node and configured to be turned on when the third switching signal is activated;

an eighth switch connected between the fifth node and the set voltage and configured to be turned on when the second switching signal is activated;

an amplifier having a negative input terminal connected to the third node and a positive input terminal connected to the set voltage;

a third capacitor connected between the third node and the sixth node from which the calibration reference voltage is output; and a discharge switch connected between the third node and the sixth node from which the calibration reference voltage is output and configured to be turned on when the first switching signal is activated.

* * * * *